US006200661B1

(12) United States Patent
Daniels et al.

(10) Patent No.: US 6,200,661 B1
(45) Date of Patent: Mar. 13, 2001

(54) LOCKER ROOM SANITARY MAT SYSTEM

(76) Inventors: Ronald W. Daniels; Joyce A. Daniels, both of 1209 E. US Hwy. 136, Pittsboro, IN (US) 46167

( * ) Notice: Subject to any disclaimer, the term of this patent is extended or adjusted under 35 U.S.C. 154(b) by 0 days.

(21) Appl. No.: 09/314,899

(22) Filed: May 20, 1999

(51) Int. Cl.[7] ..... B32B 3/06

(52) U.S. Cl. ..... 428/95; 428/62; 428/900; 4/581

(58) Field of Search ..... 428/85, 95, 900, 428/62; 15/217; 52/177; 4/581

(56) References Cited

U.S. PATENT DOCUMENTS 3,020,562 * 2/1962 Reynolds ..... 4/581
3,253,293 * 5/1966 George et al. ..... 15/215
5,069,951 * 12/1991 Egan ..... 4/581
5,173,346 * 12/1992 Middleton ..... 4/581

* cited by examiner

*Primary Examiner*—Alexander S. Thomas

(57) ABSTRACT

A sanitary apparatus is provided including a pair of mats each having a substantially planar configuration. Each mat defines a top face, a bottom face, and a periphery formed of side edges. The mats are hingably coupled for storage purposes.

6 Claims, 3 Drawing Sheets

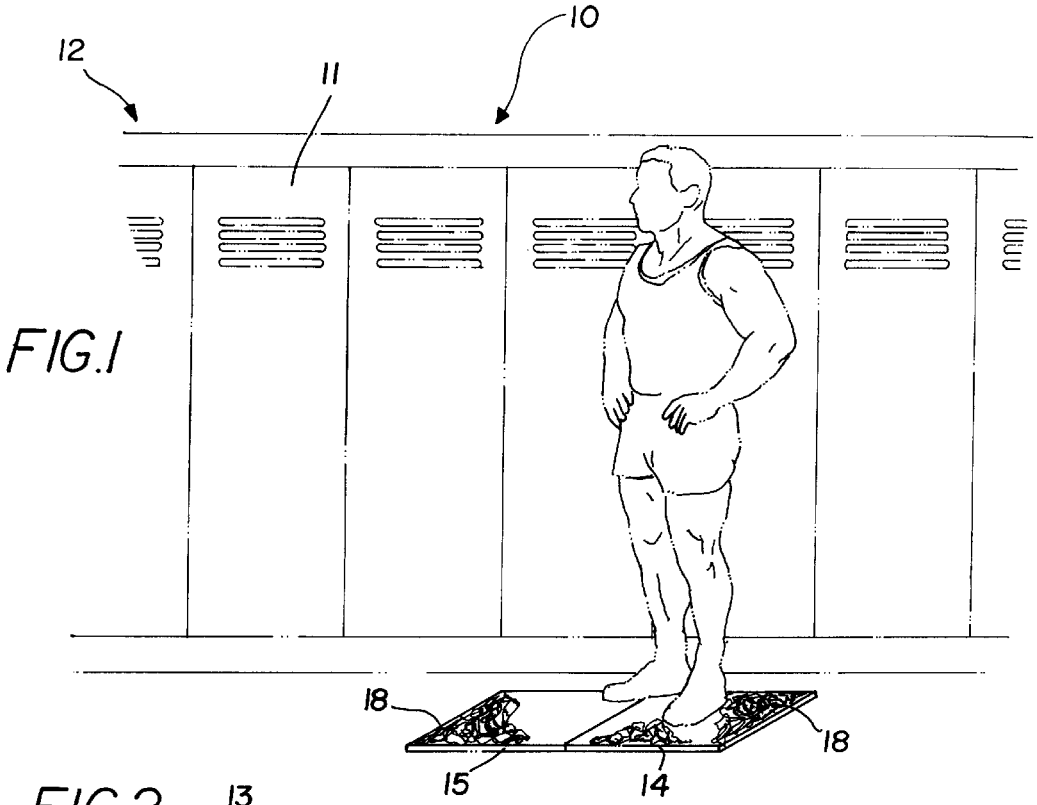
FIG.1
FIG.2
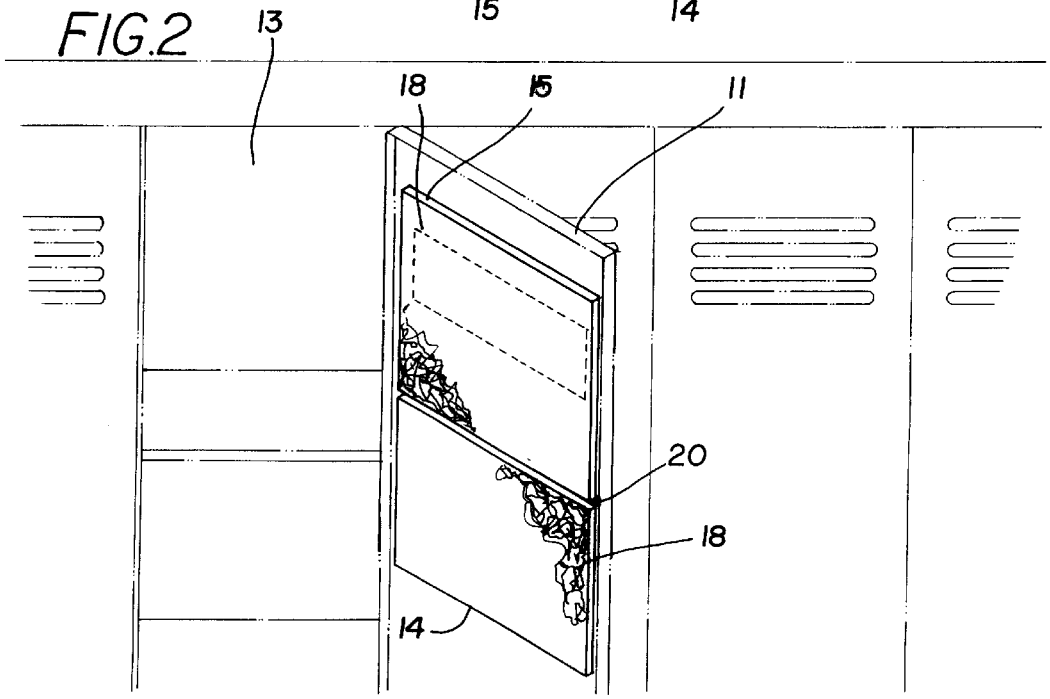

LOCKER ROOM SANITARY MAT SYSTEM

BACKGROUND OF THE INVENTION

1. Field of the Invention

The present invention relates to mats and more particularly pertains to a new locker room sanitary mat system for preventing the spread of bacteria and the like in a locker room.

2. Description of the Prior Art

The use of mats is known in the prior art. More specifically, mats heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 5,069,951; U.S. Pat. No. 3,020,562; U.S. Pat. No. 4,512,044; U.S. Patent Des. 310,460; U.S. Patent Des. 259,608; and U.S. Pat. No. 2,853,399.

In these respects, the locker room sanitary mat system according to the present invention substantially departs from the conventional concepts and designs of the prior art, and in so doing provides an apparatus primarily developed for the purpose of preventing the spread of bacteria and the like in a locker room.

SUMMARY OF THE INVENTION

In view of the foregoing disadvantages inherent in the known types of mats now present in the prior art, the present invention provides a new locker room sanitary mat system construction wherein the same can be utilized for preventing the spread of bacteria and the like in a locker room.

The general purpose of the present invention, which will be described subsequently in greater detail, is to provide a new locker room sanitary mat system apparatus and method which has many of the advantages of the mats mentioned heretofore and many novel features that result in a new locker room sanitary mat system which is not anticipated, rendered obvious, suggested, or even implied by any of the prior art mats, either alone or in any combination thereof.

To attain this, the present invention is adapted for use with a locker room having a plurality of compartments situated on a wall of a building. Each compartment has a vertically oriented substantially rectangular door hingably coupled adjacent thereto. Such doors each serve for allowing selective access to the associated compartment. For reasons that will soon become apparent, the doors are constructed from a metallic material. The present invention includes a pair of mats each having a substantially planar rectangular configuration. Each mat includes a bottom layer constructed from a water-permeable, flexible, and resilient interweaved fabric. Mounted thereon is a top layer constructed from nylon. It should be noted that each mat defines a top face, a bottom face, and a periphery defined by four substantially linear side edges. As shown in FIG. 4, a flexible strip is provided with a thin substantially planar rectangular configuration. This strip is coupled to the bottom face of the mats along side edges thereof. By this interconnection, such side edges of the mats are coextensive and the mats may be selectively folded. In use, the mats may be folded between an employed orientation wherein the mats remain in a side-by-side coplanar relationship and a stored orientation wherein the mats are stacked such that the bottom faces of the mats abut. Finally, a magnet is included with a thin substantially planar rectangular configuration. The magnet is coupled to the bottom face of one of the mats adjacent to a side edge thereof opposite that to which the flexible strip is coupled. In use, the magnet is removably coupled to an interior surface of the door of one of the locker room compartments.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new locker room sanitary mat system apparatus and method which has many of the advantages of the mats mentioned heretofore and many novel features that result in a new locker room sanitary mat system which is not anticipated, rendered obvious, suggested, or even implied by any of the prior art mats, either alone or in any combination thereof.

It is another object of the present invention to provide a new locker room sanitary mat system which may be easily and efficiently manufactured and marketed.

It is a further object of the present invention to provide a new locker room sanitary mat system which is of a durable and reliable construction.

An even further object of the present invention is to provide a new locker room sanitary mat system which is susceptible of a low cost of manufacture with regard to both materials and labor, and which accordingly is then susceptible of low prices of sale to the consuming public, thereby making such locker room sanitary mat system economically available to the buying public.

Still yet another object of the present invention is to provide a new locker room sanitary mat system which provides in the apparatuses and methods of the prior art some of the advantages thereof, while simultaneously overcoming some of the disadvantages normally associated therewith.

Still another object of the present invention is to provide a new locker room sanitary mat system for preventing the spread of bacteria and the like in a locker room.

Even still another object of the present invention is to provide a new locker room sanitary mat system that includes a pair of mats each having a substantially planar configuration. Each mat defines a top face, a bottom face, and a periphery formed of side edges. The mats are hingably coupled for storage purposes.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a perspective view of a new locker room sanitary system according to the present invention.

FIG. 2 is a perspective view of the mat of the present invention attached to the door of a locker compartment with the magnet.

DESCRIPTION OF THE PREFERRED EMBODIMENT

Figure 3:
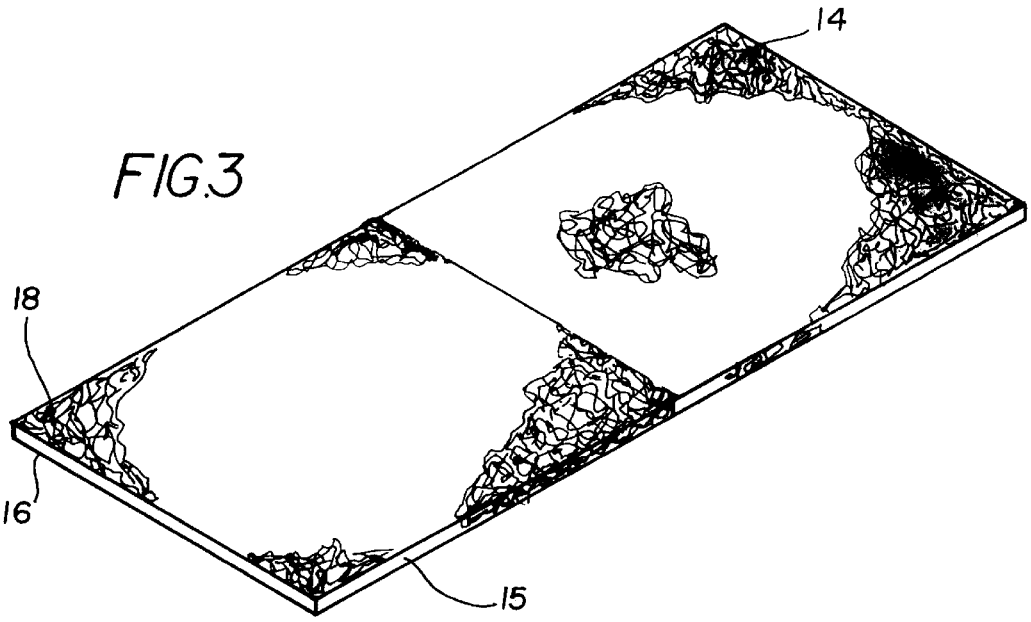
FIG. 3 is a top perspective view of the mat of the present invention in an employed orientation.

With reference now to the drawings, and in particular to FIGS. 1 through 5 thereof, a new locker room sanitary mat system embodying the principles and concepts of the present invention and generally designated by the reference numeral 10 will be described.

The present invention, designated as numeral 10, is adapted for use with a locker room 12 having a plurality of compartments 13 situated on a wall of a building. Each compartment has a vertically oriented substantially rectangular door 11 pivotally coupled adjacent thereto by at least one hinge. Such doors each serve for allowing selective access to the associated compartment. For reasons that will soon become apparent, the doors are constructed from a metallic, conductive material.

The present invention includes a pair of mats 14,15 each having a substantially planar rectangular configuration. Each mat includes a bottom layer 16 constructed from a water-permeable, flexible, and resilient interweaved fabric such as a jute backing for carpet. Mounted thereon is a top layer 18 constructed from nylon carpet so that it the top layer is resistant to rot and mildew from moisture and is quick to dry. It should be noted that each mat defines a top face, a bottom face, and a periphery defined by four substantially linear side edges.

Figure 4:
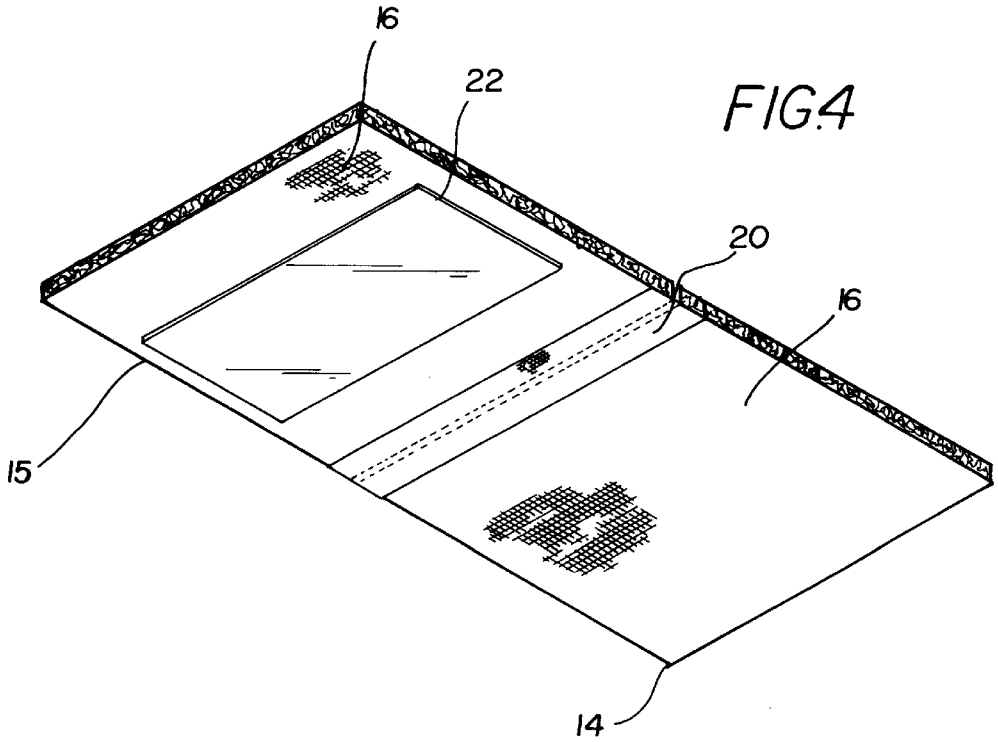
FIG. 4 is a rear perspective view of the present invention.
Figure 5:
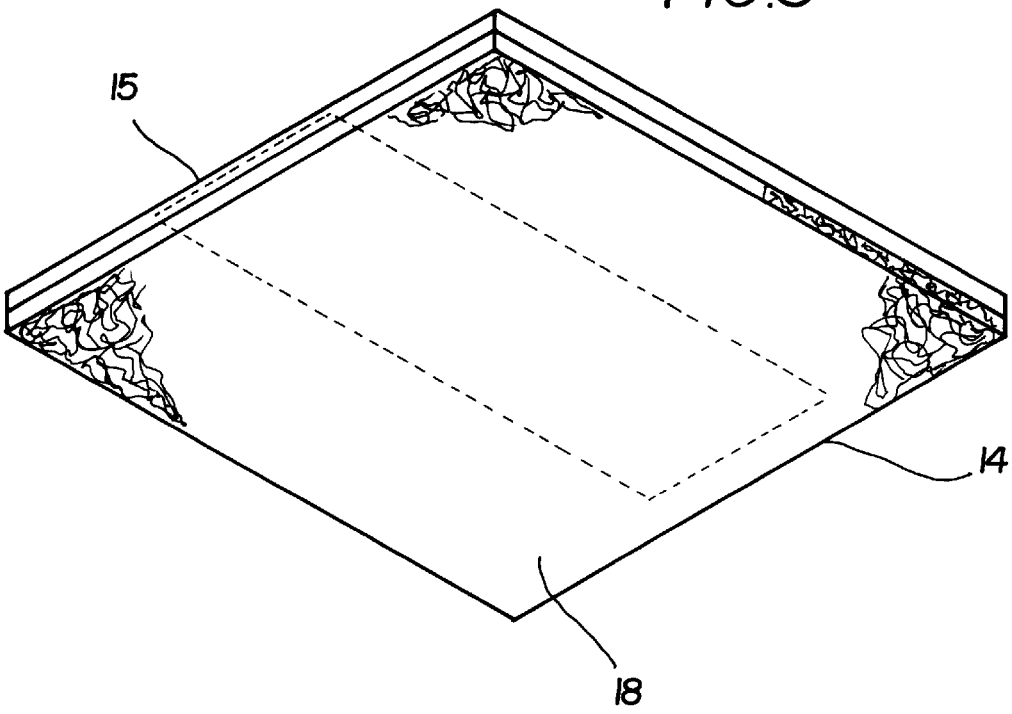
FIG. 5 is a rear perspective view of the present invention in the stored orientation.

As shown in FIG. 4, a flexible fabric strip 20 is provided with a thin substantially planar rectangular configuration. This strip is adhesively coupled to the bottom face of the mats along side edges thereof. By this interconnection, such side edges of the mats are coextensive and the mats may be selectively folded. In use, the mats may be folded between an employed orientation wherein the mats remain in a side-by-side coplanar relationship and a stored orientation (see FIG. 5) wherein the mats are stacked such that the bottom faces of the mats abut. In an optional embodiment, the mats may be integrally coupled with a crease or the like to allow the foregoing folding. Together, the mats measure 17 inches by 13 inches for providing an optimal area for a user to stand on and have space to take small steps or turns while not being too big to occupy too much floor space in a crowded locker room.

Finally, a magnet 22 (preferably made of a flexible magnetic material) is included with a thin substantially planar rectangular configuration and ideal dimensions of 4 inches and 10 inches. The magnet is adhesively coupled to the bottom face of one of the mats adjacent to a side edge thereof opposite that to which the flexible strip is coupled. In use, the magnet is removably coupled to an interior surface of the door of one of the locker room compartments. As such, a user may choose to either simply fold and store the mats within a tote bag or one of the compartments of the locker room or utilize the magnet to store the same on the door of the compartment. The dimensions of the mats allow for the user to fit them on the doors of most commonly found in locker rooms and also being small enough to be toted by the user in a standard sized gym bag. The size of the magnet has been found to be optimal for securely holding the mats of the ideal dimensions to the door of a compartment in a locker room so that the mats don't easily fall from the door from the impact shock of the door being shut to close the compartment.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A locker room sanitary system comprising, in combination:

a locker room including a plurality of compartments situated on a wall of a building;

each compartment having a vertically oriented substantially rectangular door hingably coupled adjacent thereto for allowing selective access to the compartment;

wherein the door is constructed from a metallic material;

a pair of mats each having a substantially planar rectangular configuration;

each mat including a bottom layer constructed from a water-permeable, flexible, and resilient interweaved fabric and a top layer constructed from nylon carpet, each mat defining a top face, a bottom face, and a periphery defined by four substantially linear side edges;

a flexible strip with a thin substantially planar rectangular configuration adhesively coupled to the bottom face of the mats along side edges thereof such that said side edges of the mats are coextensive and the mats may be folded at the flexible strip between an employed orientation wherein the mats remain in a side-by-side coplanar relationship and a stored orientation wherein the mats are stacked such that the bottom faces of the mats abut; and a magnet with a thin substantially planar rectangular configuration adhesively coupled to the bottom face of one of the mats adjacent to a side edge thereof which resides opposite that to which the flexible strip is coupled, the magnet being removably coupled to an interior surface of the door of one of the locker room compartments.

2. A sanitary apparatus comprising:

a pair of mats each having a substantially planar configuration, each mat defining a top face, a bottom face, and a periphery defined by side edges;

wherein the mats are hingably coupled for storage purposes; and wherein each mat includes a bottom layer constructed from a water-permeable, flexible, and resilient interweaved fabric and a top layer including carpet.

3. The sanitary apparatus as set forth in claim 2 wherein the mats are hingably coupled via a flexible strip.

4. The sanitary apparatus as set forth in claim 3 wherein the strip is coupled to the bottom face of the mats along side edges thereof such that said side edges of the mats are coextensive and the mats may be folded between an employed orientation wherein the mats remain in a side-by-side coplanar relationship and a stored orientation wherein the mats are stacked such that the bottom faces of the mats abut.

5. The sanitary apparatus as set forth in claim 2 wherein a magnet is coupled to the bottom face of one of the mats for being removably coupled to an interior surface of a door of a locker room.

6. A locker room sanitary system for a plurality of compartments situated on a wall of a building, wherein each compartment has a vertically oriented substantially rectangular door hingably coupled adjacent thereto for allowing selective access to the compartment and the door is constructed from a metallic material, said system comprising:

a pair of mats;

each mat including a bottom layer constructed from a water-permeable, flexible, and resilient interwoven fabric and a top layer constructed from nylon carpet, each mat defining a top face, a bottom face, and a periphery defined by four side edges;

a flexible strip adhesively coupled to the bottom face of the mats along side edges thereof such that said side edges of the mats are coextensive and the mats may be folded at the flexible strip between an employed orientation wherein the mats remain in a side-by-side coplanar relationship and a stored orientation wherein the mats are stacked such that the bottom faces of the mats abut; and a magnet adhesively coupled to the bottom face of one of the mats adjacent to a side edge thereof which resides opposite that to which the flexible strip is coupled, the magnet being removably coupled to an interior surface of the door of one of the locker room compartments.

* * * * *